United States Patent [19]

Chachin et al.

[11] 4,030,329

[45] June 21, 1977

[54] DEVICE FOR ELECTRICAL DISCHARGE FORMING

[76] Inventors: Viktor Nikolaevich Chachin, bulvar Lunacharskogo, 8, kv. 21; Alexandr Julyanovich Zhuravsky, prospekt Partizansky, 28, korpus 2, kv.135; Gennady Nikolaevich Zdor, ulitsa V.Khoruzhei, 19, kv. 14; Vladimir Leontievich Shaduya, ulitsa Pervomaiskaya, 8, kv. 7; Elena Yakovlevna Golovkina, ulitsa Kakhovskaya, 37, kv. 42, all of Minsk, U.S.S.R.

[22] Filed: July 12, 1976

[21] Appl. No.: 704,177

[52] U.S. Cl. ..... 72/56; 72/DIG. 24

[51] Int. Cl.[2] ..... B21D 26/02

[58] Field of Search ..... 72/56, DIG. 24, DIG. 25; 29/421 E

[56] References Cited

UNITED STATES PATENTS

| | | | |
|---|---|---|---|
| 3,603,127 | 9/1971 | Haeusler | 72/56 |
| 3,680,397 | 8/1972 | Haeusler | 72/56 |
| 3,750,441 | 8/1973 | Schneider | 72/56 |
| 3,852,985 | 12/1974 | Haeusler | 72/56 |

*Primary Examiner*—Leon Gilden
*Attorney, Agent, or Firm*—Lackenbach, Lilling & Siegel

[57] ABSTRACT

A device for electrical discharge forming comprises a fixed plate upon which is mounted an explosion chamber. Said chamber accommodates an electrode while its wall serves as the other electrode. To set off an explosion, the electrodes are electrically connected by a wire fed into the explosion chamber through a hole in its wall, said hole being made in the area of a step formed in the chamber wall. Installed near this hole are two knives one of which is rigidly fixed while the other one is movable for approaching the first knife and cutting off the wire. The cut-off end of the wire comes to rest on said step. In the device according to the invention the end of the wire does not stick to the hole in the chamber wall which eliminates the necessity of the operator cleaning the hole before feeding a fresh piece of the wire into the chamber.

3 Claims, 2 Drawing Figures

DEVICE FOR ELECTRICAL DISCHARGE FORMING

Figure 1:
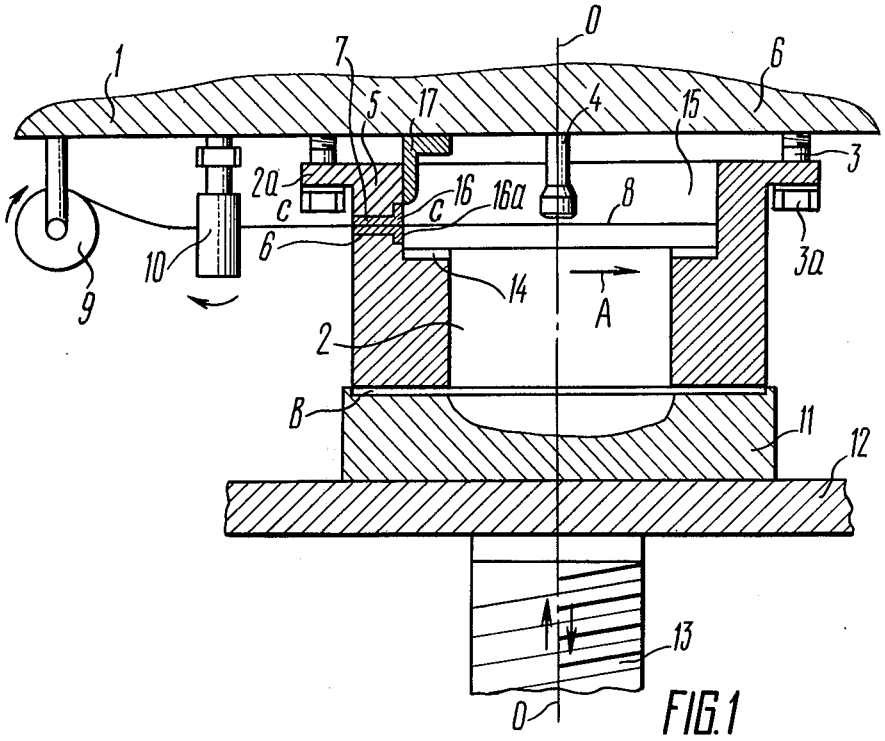

The present invention relates to high-speed shaping of materials and more particularly it relates to devices for electrical discharge forming.

The device according to the present invention can be employed in machine-building, instrument-building, aircraft and other industries.

The present invention can be used successfully for electrical discharge forming of complex-shaped articles from sheet and tubular blanks made of hard-to-work materials.

The device according to the present invention can also be used in other installations wherein the electrical discharge is initiated by a wire.

Widely known in the prior art is a device for electrical discharge forming comprising a fixed plate and an explosion chamber mounted on it. One electrode is located inside said chamber whose wall serves as the other electrode. The explosion chamber is filled with a working fluid which is capable of conveying the energy of explosion to the work.

The discharge utilized for electrical discharge forming is initiated by a wire which connects the electrodes. The wire is fed into the explosion chamber through a hole in its wall from a feeding reel over guide rollers installed outside the explosion chamber.

The process of electrical discharge forming is carried out by pressing the die with the work tightly against the explosion chamber. Simultaneously, the wire fed into the fluid-filled explosion chamber comes in contact with the electrode and closes the electric circuit. The impact wave created by the explosion of the wire shapes the work. The portion of the wire located in the explosion chamber burns up completely.

A disadvantage of the known device lies in that, due to the high temperature of the explosion, the end of the wire gets stuck to the wall of the explosion chamber.

In order to feed a fresh portion of wire into the explosion chamber for the next forming cycle it is necessary to remove the stuck wire end from that part of the hole which opens into the explosion chamber.

The operation of cleaning the hole is rather difficult and is time consuming.

Moreover, access of the operator to the hole in the explosion chamber for feeding the wire in the known device is difficult.

In view of this disadvantage the efficiency of labor during electrical discharge forming with the aid of the known device is too low.

The main object of the invention is to provide a device for electrical discharge forming wherein the design of the explosion chamber would rule out the sticking of the wire to the wall of the chamber.

This object is accomplished by providing a device for electrical discharge forming which comprises a fixed plate upon which is mounted an explosion chamber with an electrode inside, the wall of said chamber, which serves as the other electrode, having a hole for the passage of a wire intended to connect electrically the electrodes, and a die pressed against the explosion chamber in the course of forming. According to the invention, the wall of the explosion chamber at the side opposite to that adjoining the die has a step located somewhat lower than the hole for the passage of the wire and wherein said chamber is provided with two knives installed near said hole and intended for cutting off the wire, one of said two knives being rigidly fixed while the other one is movable along the geometrical axis of the explosion chamber so that when the die moves together with said chamber towards the fixed plate, the knives approach each other and cut off the wire whose sheared end then comes to rest on the step.

Owing to such an arrangement the wire during electrical discharge forming does not stick to the wall of the explosion chamber.

It is practicable that the step should be formed by a circular recess in the explosion chamber wall at the side opposite to that adjoining the die.

Such a recess keeps the ends of the wire in the required position in the explosion chamber.

It is recommended that the explosion chamber should be mounted on the fixed plate with a provision for moving along its geometrical axis over a distance which is equal to the distance between the step and the geometrical axis of the hole for the passage of the wire.

Such a solution ensures reliable contact of the wire with the electrode inside the explosion chamber; in addition, the operation of cutting off the wire is combined with gripping the work.

The use of the present invention in the process of electrical discharge forming eliminates the sticking of the wire end to the explosion chamber wall. As a result, there is no need for the operator to clean the part of the hole opening into the explosion chamber of the stuck end of the wire to facilitate feeding a fresh piece of the wire for the next forming cycle.

In addition, the device according to the invention reduces the total time required for manufacturing an article. Moreover, no additional time is spent cutting the wire since the wire is cut simultaneously with gripping the work.

The device according to the present invention raises the efficiency of the labor involved in electrical discharge forming.

Figure 2:
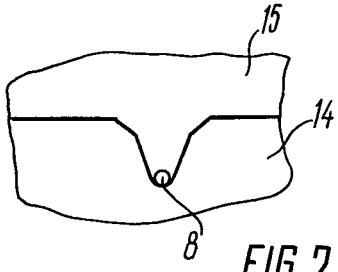

Now the invention will be described in detail by way of example with reference to the accompanying drawings, in which:

FIG. 1 is a schematic longitudinal section through the device for electrical discharge forming according to the invention; and FIG. 2 is a view of the device in the direction of arrow A in FIG. 1.

The device for electrical discharge forming according to the invention comprises a fixed plate 1 (FIG. 1) upon which is mounted an explosion chamber 2 by screws 3 with a provision for moving relative to the plate 1, said screws 3 serving as guides for the explosion chamber 2 and passing through its flange 2*a*. The explosion chamber 2 is filled with a fluid, in this case water, which conveys the energy of explosion to the work. The explosion chamber 2 accommodates an electrode 4 while the wall 5 of said chamber serves as the other electrode (referred to hereinafter also as number 5) and has a hole 6. Installed in said hole is a sleeve 7 for the passage of the wire 8 which is intended to connect electrically the electrodes 4 and 5. The wire 8 is delivered into the chamber 2 from a feeding reel 9 secured on the plate 1 outside the chamber 2; the wire is moved by guide rollers 10 which straighten it on the way. The device comprises a die 11 secured on the movable plate 12 which is connected with the screw 13 to the die-pressing mechanism (not shown in the drawing). In the course of electrical discharge forming said die is pressed against the explosion chamber 2. At the side opposite to that adjoining the die 11, the explosion chamber wall has a portion with a step 14 near the hole 6 (FIG. 1 and FIG. 2), said portion being formed by a circular recess 15 made in the wall of the explosion chamber 2 at the side opposite to that adjoining the die 11. In the described version of the device there are two knives 16 and 17 (FIG. 1) for cutting off the wire 8. The knive 16 is located on the end of the sleeve 7 directed into the explosion chamber 2. The cutting edge 16*a* of the knife 16 is made on the face surface of the sleeve 7 directed into the explosion chamber, along the periphery of its hole for the passage of the wire 8. The other knife 17 is secured on the fixed plate 1 with a provision for moving in the direction of the geometrical axis O — O of the explosion chamber 2 when the latter moves relative to the fixed plate 1 and, consequently, relative to the knife 16 which is rigidly fixed on the wall of the explosion chamber 2.

The distance between the step 14 and the geometrical axis C — C of the hole 6 for the passage of the wire 8 is equal to the travel of the explosion chamber 2 to the fixed plate 1 over the guides in the form of screws 3.

This ensures the cutting off of the wire 8 when the explosion chamber 2 moves towards the fixed plate 1 and when the knives 16 and 17 approach each other, and the reliable contact of the wire 8 with the electrode 4.

The device for electrical discharge forming functions as follows.

In the initial position the movable plate 12 mounting the die 11 occupies the downmost position in which the die 11 is located at a certain distance from the explosion chamber 2 which rests on the heads 3*a* (FIG. 1) of the screws 3.

The wire 8 is inserted into the sleeve 7.

The operator puts the work B (FIG. 1) on the die 11 after which the wire 8 is unwound by the rollers 10 from the feeding reel 9 and is straightened while passing over said rollers. The wire 8 is fed through the sleeve 7 into the explosion chamber 2 all the way to bear against the opposite surface of its wall.

Then the die-pressing mechanism (not shown in the drawing) is set into action. The movable plate 12 with the die 11 places the work B in contact with the explosion chamber 2.

Now the explosion chamber starts moving over the guide screws 3 through a distance equal to the distance between the step 14 and the geometrical axis C — C of the hole 6. In the course of this movement the knife 17 slides over the face surface of the knife 16 thus cutting off the wire 8. The cut-off portion of the wire falls by gravity on the step 14' formed by the circular recess 15. During the further movement of the explosion chamber 2 towards the fixed plate 1 the wire 8 reaches the electrode 4 and closes the electric circuit. Meanwhile the explosion chamber 2 is pressed against the fixed plate 1.

Then the explosion chamber 2 is filled with water and a high voltage is connected to the electrode 4. There occurs a high-voltage discharge between the electrodes 4 and 5 with a resultant explosion and burning up of the wire 8. The impact waves created in the water by the explosion reach the work B and carry out the process of electrical discharge forming.

Owing to the fact that the outlet hole of the sleeve 7 is completely covered by the knife 17 at the movement of explosion of the wire 8, the wire 8 fed into the explosion chamber 2 for the next forming cycle cannot be pushed out of the hole in the sleeve 7 by the impact wave.

Then the die 11 with the work and the explosion chamber 2 go down to the initial position and the water is discharged from the explosion chamber 2. The operator takes out the formed article and the device is again ready for the next forming cycle.

An experimental specimen of the device for electrical discharge forming according to the invention has passed all-round tests which confirmed its reliability and sufficiently high output.

In the device according to the invention the wire is cut off and brought to the working position simultaneously with pressing down the work.

The use of the device according to the invention eliminates completely any manual labour involved in setting the wire in position.

The parts manufactured by the device according to the invention are of a high quality.

What is claimed is:

1. A device for electrical discharge forming comprising: a fixed plate; an explosion chamber mounted on said fixed plate; a die pressed against said explosion chamber in the course of forming; an electrode accommodated in said explosion chamber; a wall of said explosion chamber serving as the other electrode and having a hole; a wire passing through said hole and intended to connect electrically said electrodes; a step made in said wall at the side opposite to that adjoining said die and located somewhat lower than said hole for the passage of said wire, two knives for cutting of said wire, one of said two knives being secured rigidly near said hole and the other one of said two knives being movably installed near said hole for moving along the geometrical axis of said explosion chamber so that when said die moves together with said explosion chamber towards said fixed plate, said two knives approach each other and cut off said wire whose sheared end then comes to rest on said step.

2. A device according to claim 1 wherein said step is formed by a circular recess on said wall of said explosion chamber at the side opposite to that adjoining said die.

3. A device according to claim 1 wherein said explosion chamber is mounted on said fixed plate with a provision for moving along its own geometrical axis through a distance which is equal to the distance between said step and said hole for the passage of said wire.

* * * * *